US006492950B2

(12) United States Patent
Nakano et al.

(10) Patent No.: US 6,492,950 B2
(45) Date of Patent: Dec. 10, 2002

(54) PATCH ANTENNA WITH DIELECTRIC SEPARATED FROM PATCH PLANE TO INCREASE GAIN

(75) Inventors: Hiroshi Nakano, Yamanashi (JP); Yasutake Hirachi, Yamanashi (JP)

(73) Assignee: Fujitsu Quantum Devices Limited, Yamanashi (JP)

( * ) Notice: Subject to any disclaimer, the term of this patent is extended or adjusted under 35 U.S.C. 154(b) by 0 days.

(21) Appl. No.: 09/957,080

(22) Filed: Sep. 21, 2001

(65) Prior Publication Data

US 2002/0041254 A1 Apr. 11, 2002

(30) Foreign Application Priority Data

Sep. 29, 2000 (JP) ..... 2000-301373

(51) Int. Cl.[7] ..... H01Q 1/32; H01Q 1/38

(52) U.S. Cl. ..... 343/700 MS; 343/702

(58) Field of Search ..... 343/700 MS, 846, 343/872, 873, 898, 789, 753

(56) References Cited

U.S. PATENT DOCUMENTS 4,415,900 A * 11/1983 Kaloi ..... 343/700 MS
5,023,624 A * 6/1991 Heckaman et al. ..... 343/860
5,760,744 A * 6/1998 Sauer ..... 343/700 MS
6,118,405 A * 9/2000 Mckinnon et al. ... 343/700 MS

FOREIGN PATENT DOCUMENTS

JP 6-80971 10/1994

* cited by examiner

*Primary Examiner*—Don Wong
*Assistant Examiner*—James Clinger
(74) *Attorney, Agent, or Firm*—Armstrong, Westerman & Hattori, LLP

(57) ABSTRACT

A dielectric member 27 with a thickness of from $0.1\lambda$ to $2\lambda$ is disposed opposite to a patch plane 17 of a patch antenna 10A apart from the patch plane 17 by a distance of from $0.1\lambda_0$ to $2\lambda_0$, where $\lambda_0$ and $\lambda$ are the wavelengths of a radiated radio wave in free space and in the dielectric member, respectively. The dielectric constant of the dielectric member 27 may be lower in an outer portion thereof than a middle portion thereof. When the antenna is incorporated into the communication module, the dielectric member 27 is attached to the cover of the communication module.

18 Claims, 10 Drawing Sheets

PATCH ANTENNA WITH DIELECTRIC SEPARATED FROM PATCH PLANE TO INCREASE GAIN

BACKGROUND OF THE INVENTION

1. Field of the Invention

The present invention relates generally to a patch antenna with a dielectric separated from a patch plane, more particularly, to a patch antenna with a dielectric plate separated from a patch plane by an air gap to increase the gain of the antenna for a millimeter wave frequency range from 30 to 300 GHz and microwave frequencies near the millimeter wave frequencies.

2. Description of the Related Art

A patch antenna is thin and compact in shape, so the antenna is used in millimeter wave radio communication. Note that in the present specification, a patch antenna is defined as an antenna including a patch plane provided with high frequency power for radiating radio waves and a ground plane separated from the patch plane, wherein the patch plane and the ground plane are generally formed on opposed surfaces of a dielectric substrate. Since in millimeter waves, patch antennas have low gain, improvement has been performed on the gain by use of an array configuration or a dielectric lens.

However, an array antenna has a plurality of patch planes arranged on a dielectric substrate and there is a necessity for supplying power to respective patch planes with controlling the values and phases thereof and in addition, for distributing the power supply through a micro strip line along which power transfer loss is comparatively large in millimeter waves; therefore it is not easy that an actual practice coincides with its design. Further, when a dielectric substance which is low in power transfer loss is selected, it results in increase in cost of the antenna. Furthermore, since it is necessary to dispose patch planes spaced apart from each other by a distance equal to or more than $0.5\lambda$ to $\lambda$, where $\lambda$ is a wavelength, the area of an array antenna is large.

Whereas in order to improve the gain of a patch antenna using a dielectric lens, it is necessary for a lens to be larger than the angular aperture of the patch antenna, and on the other hand, since this angular aperture is generally wide, a large lens is necessary. Moreover, in order to obtain a high efficiency antenna, alignment precision between the patch antenna and the dielectric lens has to be high, which in turn requires high levels of techniques associated with assembly and inspection, leading to high cost.

In order to solve such problems with using a patch antenna, there is disclosed in JP 6-809715 A an antenna as shown in FIG. 10.

A patch antenna 10 is disposed between a reflection plate 11 and a dielectric block 12 with spacing from the reflection plate 11. A spacer 13 is placed between the reflection plate 11 and the dielectric block 12 and a micro strip line 14 is connected to the patch plane of the patch antenna 10.

The publication discloses that a gain can be increased by making multiple reflections, between the reflection plate 11 and the dielectric block 12, of radio waves radiated from the patch antenna 10 and aligning the phase planes of radio waves transmitted through the dielectric block 12 so as to increase the directivity of the antenna, and further by resonating the radio waves in the dielectric block.

In the antenna of FIG. 10, however, not only the dielectric block 12 but also the reflection plate 11 has to be added to the patch antenna 10, and moreover it is necessary to optimize a distance between the patch antenna 10 and the dielectric block 12, a thickness of the dielectric block 12, and further a distance between the patch antenna 10 and the reflection plate 11.

SUMMARY OF THE INVENTION

Accordingly, it is an object of the present invention to provide an improved patch antenna capable of increasing the gain with simpler configuration.

In a first aspect of an antenna according to the present invention, a dielectric member is disposed on the patch plane side of an patch antenna opposite to the patch plane with a distance of $0.1\lambda_0$ to $2\lambda_0$ from the patch plane, where $\lambda_0$ denotes a wavelength of a radio wave, in a free space, radiated from the antenna. A plane located opposite to the patch antenna on the opposite side to the dielectric member with respect to the patch antenna may be either a non-conductive plane or a conductive plane. In the case of the conductive plane, it is not necessary to adjust distances among the patch antenna, the dielectric member and the conductive plane so as to make phases of radiated radio wave coincident as in the above described prior art configuration. The conductive plane is separated from the dielectric member by such a distance that phases of the radio wave directly reached an incident surface of the dielectric member are substantially different from those indirectly reached the incident surface after having been reflected by the conductive plane.

According to the antenna of the present invention, by providing high frequency power to the patch antenna, a radio wave is radiated from the patch plane and passes through the dielectric member. The dielectric member is polarized by the electromagnetic wave and electromagnetic field is provided to the patch plane from the dielectric member to change the current distribution in the patch plane. By determining the distance between the dielectric member and the patch plane as described above, he current density grows larger mainly at a peripheral portion of the patch plane compared with a case where no dielectric member is employed. Thereby directivity arises in electromagnetic radiation pattern to increase the gain. A current distribution on the patch plane is controlled such that the directivity arises in the electromagnetic radiation pattern to increase the gain by operation of the dielectric member.

The principle of the present invention for achieving high gain is different from that of the known configuration employing the reflection plate 11 as shown in FIG. 10, and there is no need to employ the reflection plate 11 whose position is precisely adjusted; therefore the patch antenna of the first embodiment can increase the gain with a simpler configuration. That is, in this known configuration, strict positioning of the reflection plate 11 and others is required in order to make phases coincident between a radio wave directly transmitted through the dielectric member after having been radiated from the patch antenna and radio waves indirectly transmitted through the dielectric member after having been reflected by the reflection plate 11, whereas the present invention requires no such positioning even when the conductive plane is provided. It is a unique conception of the present invention to achieve high gain of the antenna with increasing current densities at a peripheral portion of the patch plane by the dielectric member.

In order to realize the present invention, it is only required that a dielectric member is disposed on the patch plane side of the patch antenna opposite to the patch plane with a distance of $0.1\lambda_0$ to $2\lambda_0$ from the patch plane, and a plane located opposite to the patch antenna on the opposite side to the dielectric member with respect to the patch antenna may be a non-conductive plane, that is, a nonreflective plane. In a case where the plane is a conductive plane, it is separated from the patch antenna or the dielectric member by such a distance that phases of the radio wave directly reached an incident surface of the dielectric member are substantially different from those indirectly reached the incident surface after having been reflected by the conductive plane. In order to realize the substantially different phases, it may be performed that the phase of the radio wave directly reached the incident surface of the dielectric member is determined, the phase of the radio wave indirectly reached the incident surface after having been reflected by the conductive plane is determined, and the both phases are made substantially different from each other, for example, opposite to each other. In design of the antenna, it may be performed that simulation of radiation pattern of is performed with taking into consideration dielectric constants of respective portions of the antenna according to the present invention and phase shifts of radio waves passing through the respective portions, and the phase condition is derived from the results of the simulation.

In a second aspect of an antenna according to the present invention, the dielectric member has a thickness of from $0.1\lambda$ to $2\lambda$ in the first aspect, where $\lambda$ is a wavelength of the radiated radio wave in the dielectric member.

According to this antenna, the electromagnetic field provided to the patch plane from the dielectric member is strengthened compared with a case where the thicknesses fall outside this range, and thereby the above effect is enhanced.

In a third aspect of an antenna according to the present invention, the dielectric member has a first dielectric in a middle portion thereof and a second dielectric disposed around the middle portion with a dielectric constant lower than that of the first dielectric in the first aspect.

According to this antenna, since the dielectric member also works as a dielectric lens, a directivity is increased more than in the first aspect, thereby increasing the gain of the antenna.

In one aspect of a communication module according to the present invention, since the dielectric member is attached to the cover of the communication module, high gain of the antenna can be achieved with substantially the same size as a prior art patch antenna.

Other aspects, objects, and the advantages of the present invention will become apparent from the following detailed description taken in connection with the accompanying drawings.

DESCRIPTION OF THE PREFERRED EMBODIMENTS

Figure 1:
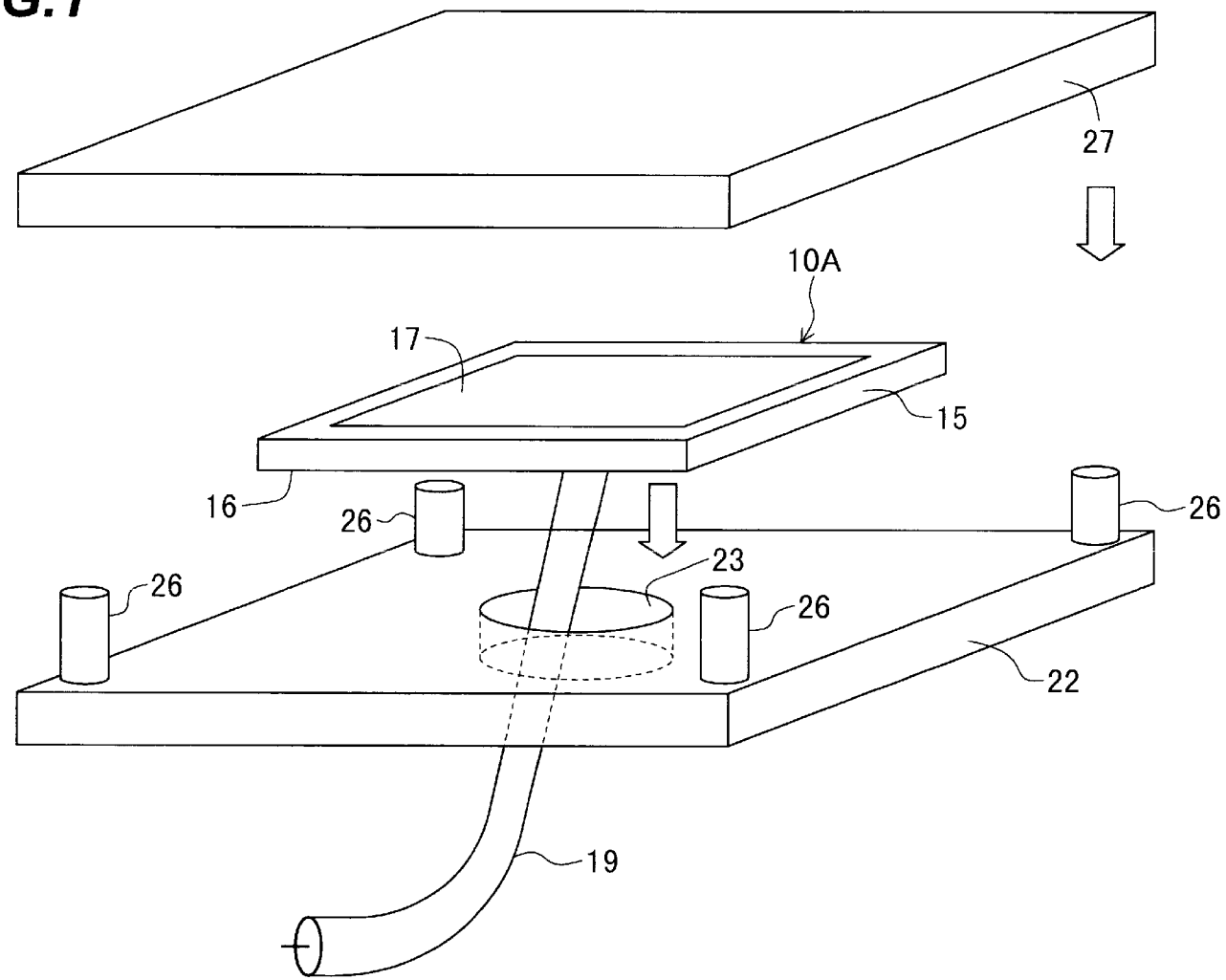
FIG. 1 is an exploded perspective view of an improved patch antenna of a first embodiment according to the present invention.

Referring now to the drawings, wherein like reference characters designate like or corresponding parts throughout several views, preferred embodiments of the present invention are described below.

First Embodiment

Figure 2:
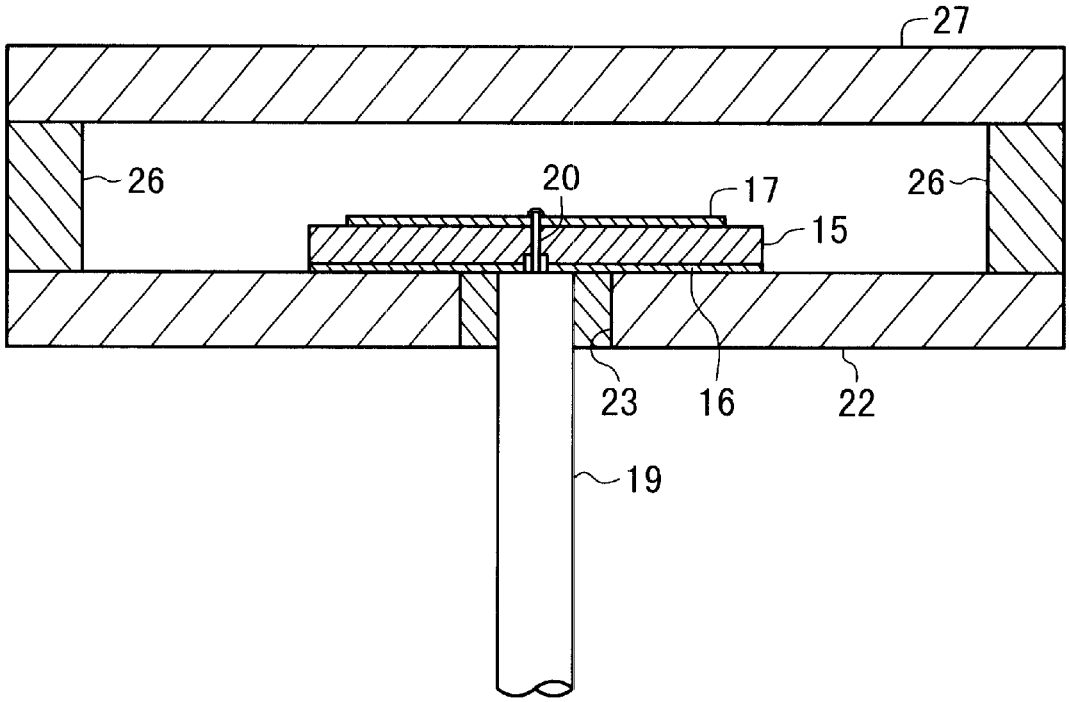
FIG. 2 is a partial cross-sectional view of the assembled antenna of FIG. 1.

FIG. 1 is an exploded perspective view of an improved patch antenna of a first embodiment according to the present invention, and FIG. 2 is a partial cross-sectional view of the assembled antenna.

A patch antenna 10A has a dielectric substrate 15, and on opposite surfaces thereof, a ground plane 16 and a patch plane 17 are respectively formed. The dielectric substrate 15 is made of, for example, $SiO_2$ and has a thickness of from 200 to 500 $\mu$m. Each of the ground plane 16 and the patch plane 17 is made of a metal film having a thickness of several $\mu$m. The patch plane 17 has a side of $\lambda_0/2$, where $\lambda_0$ is a wavelength of a radiated radio wave in free space.

A hole is formed in a middle portion of the dielectric substrate 15, a core conductor 20 of a coaxial cable 19 runs through the hole and an end of the core conductor is soldered to the patch plane 17. Corresponding to this hole, a hole 23 is formed in a supporting substrate 22 and the end of the central conductor of the coaxial cable 19 runs through the hole 23 and the end thereof is fixed to the supporting substrate 22. The outside conductor of the coaxial cable 19 is connected to the ground plane 16. The supporting substrate 22 is an insulator and a dielectric member 27 is fixed to the supporting substrate 22 through spacers 26 arranged at corners thereof.

The dielectric member 27 is made of, for example, $Al_2O_3$ and has a thickness of from $0.1\lambda$ to $2\lambda$, where $\lambda$ is a wavelength of a radiated radio wave in the dielectric member 27. A distance between the dielectric member 27 and the patch plane 17 is in the range of from $0.1\lambda$ to $2\lambda$ for achievement of a high gain described later.

Figure 3:
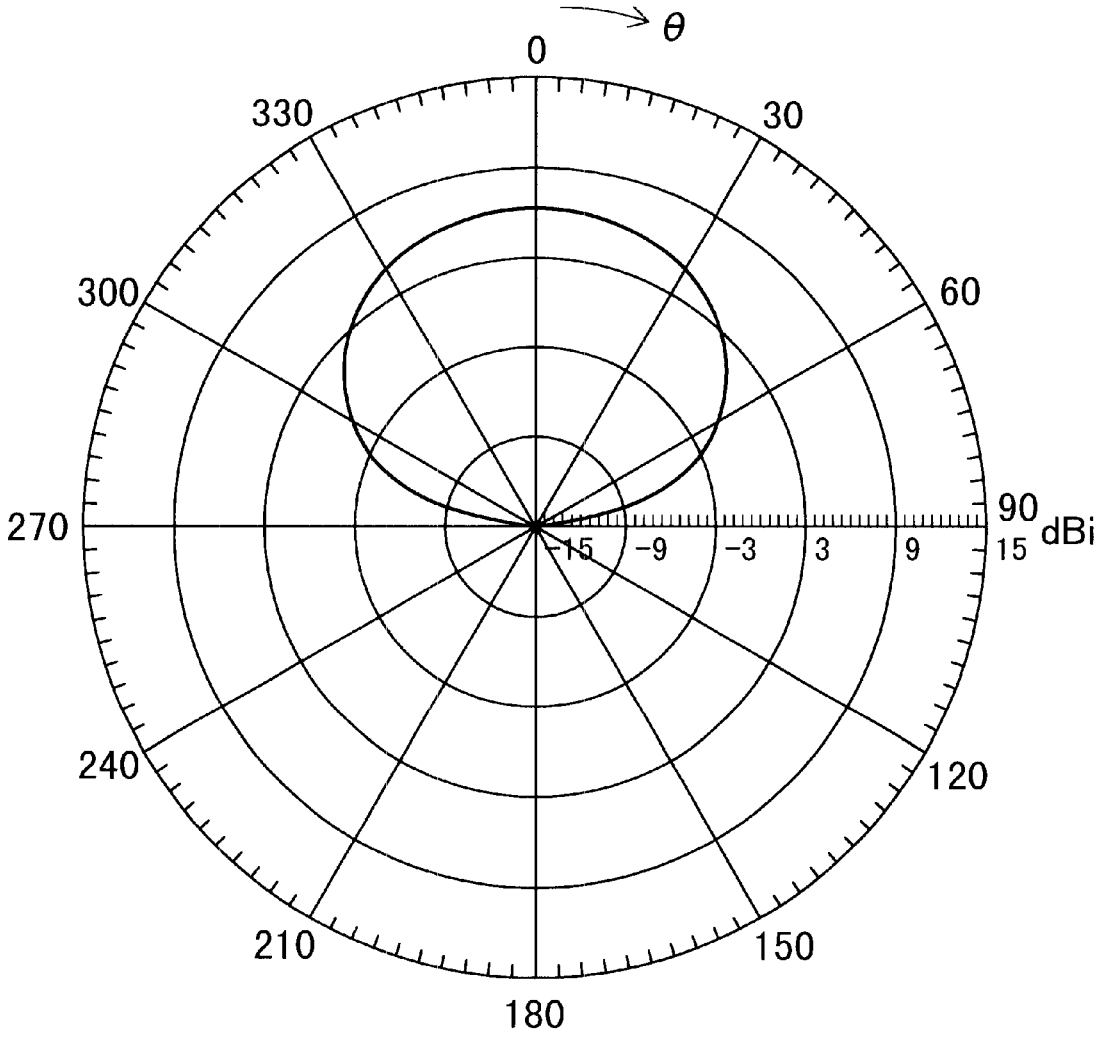
FIG. 3 is a radiation pattern diagram showing a directivity of a patch antenna obtained by excluding a dielectric substrate from the configuration of FIG. 1.
Figure 4:
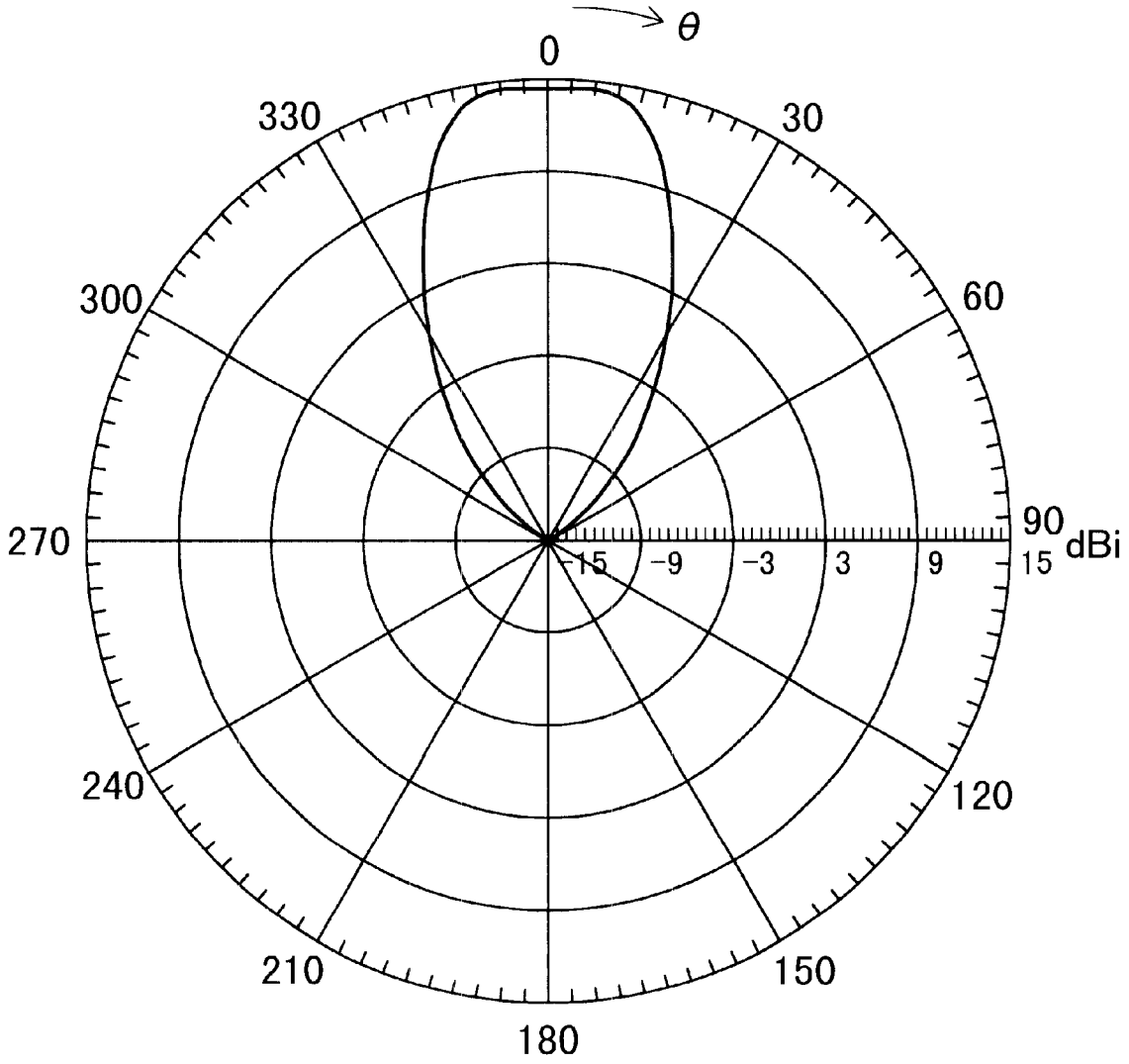
FIG. 4 is a radiation pattern diagram showing a directivity of the improved patch antenna of FIG. 1.

Radiation patterns were measured on the improved patch antenna of the above-described configuration in cases where the dielectric member 27 was not used and was used, and the results shown in FIGS. 3 and 4, respectively, were obtained.

In this experiment, the same high frequency power was provided to the patch antenna 10A in both cases where the dielectric member 27 was not used and was used. The radio wave was measured at the frequency of 59.8947 GHz, which was the maximum in intensity.

In FIGS. 3 and 4, the scale in a radial direction is the gain (dBi) and the scale in a circular direction is the angle $\theta$ with respect to the direction of the core conductor 20. The radiation angle is a central angle between two points each having a gain lower than the maximum gain by 3 dB, and the radiation angles of FIGS. 3 and 4 were about 60 degrees and about 30 degrees, respectively. The antenna gains of FIGS. 3 and 4 were 7 dBi and 15 dBi, respectively. As a result, according to the antenna of the first embodiment, the directivity thereof is improved with increase in gain.

The reason why such an effect is obtained is as follows: When high frequency power is provided through the coaxial cable 19 to the antenna 10A, a radio wave is radiated from the patch plane 17 and transmitted through the dielectric member 27. By the radio wave, the dielectric member 27 is polarized and an electromagnetic field is provided on the patch plane 17 from the dielectric member 27 to change a current distribution in the patch plane 17. By determining a distance between the patch plane 17 and the dielectric member 27 as described above, current densities grow larger mainly at a peripheral portion of the patch plane than in a case where no dielectric member 27 is employed. With this, the directivity arises in an electromagnetic radiation pattern to improve the gain. That is, by the operation of the dielectric member 27, the current distribution on the patch plane 17 is controlled such that the directivity arises in an electromagnetic radiation pattern to improve the gain.

A simulation was performed to confirm how much current density on the patch plane is increased by placing the dielectric member 27 as described above, and the following results were obtained:

In cases where the dielectric member 27 was not disposed and was disposed apart from the patch plane 17 by $3\lambda$., current distributions on the patch plane 17 were almost the same as each other.

In a case where the dielectric member 27 was disposed apart from the patch plane 17 by $0.4\lambda_0$, current distribution on the patch plane 17 had current densities of about twice and thrice at middle and peripheral portions, respectively, of the patch plane 17 as large as respective those in a case where the dielectric member 27 was not disposed.

In a case where the dielectric member 27 was disposed apart from the patch plane 17 by a distance from $0.1\lambda_0$ to $2\lambda_0$, a current density increased, especially, at a peripheral portion of the patch plane 17 more than a case where the dielectric member 27 was not disposed.

Figure 10:
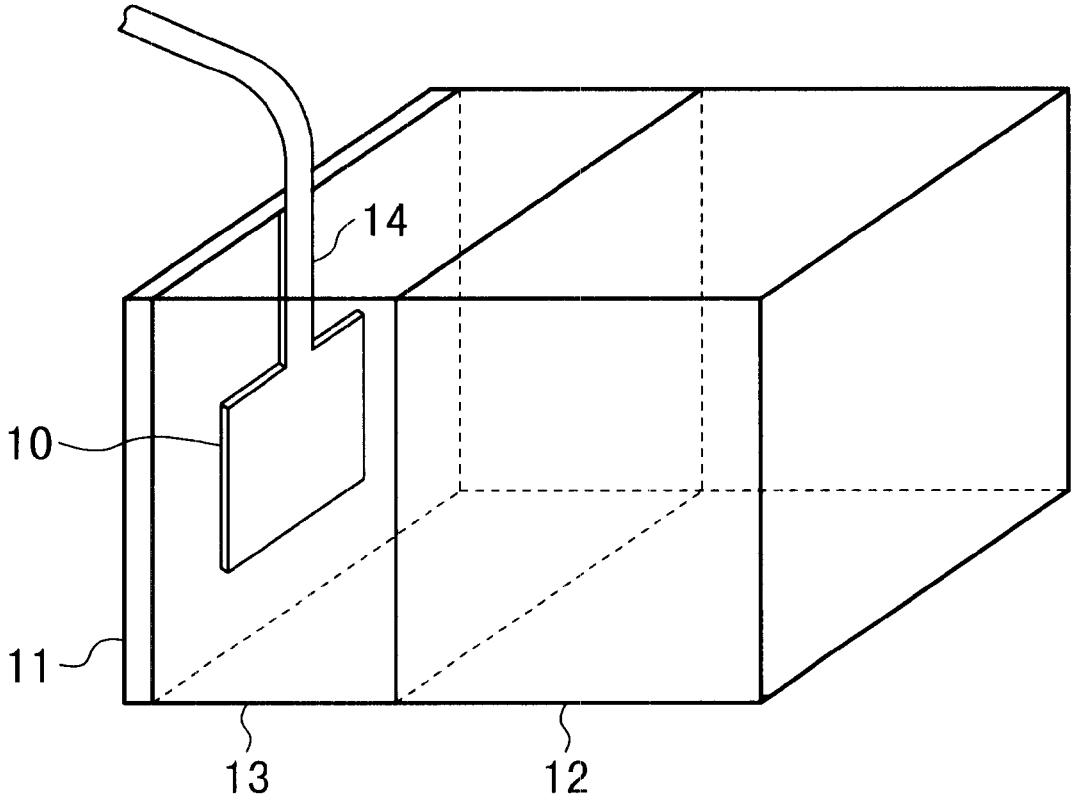
FIG.10 prior art
FIG. 10 is a perspective view showing a prior art high gain patch antenna.

The improved patch antenna of the first embodiment, whose principle for achieving high gain is different from that of the configuration employing the reflection plate 11 as shown in FIG. 10, and there is no need to employ the reflection plate 11; therefore the patch antenna of the first embodiment can increase the gain with a simpler configuration.

Furthermore, by determining the thickness of the dielectric member 27 in the range as described above, the electromagnetic field provided onto the patch plane 17 from the dielectric member 27 is strengthened more than the case where the thickness is out of the range, thereby enhancing the above described effect.

Still further, the dielectric member 27 is different from a lens but is a flat plate, so no axial alignment is required between the patch antenna 10A and the dielectric member 27. In addition, the dielectric member 27 is different from a lens and has no focus, which leads to no requirement for determining a distance between the dielectric member 27 and the patch antenna 10A with good precision. Therefore, high levels of techniques associated with assembly and inspection are not required, thereby enabling a fabrication cost to decrease in comparison with a case where a dielectric lens is employed.

Second Embodiment

Figure 5:
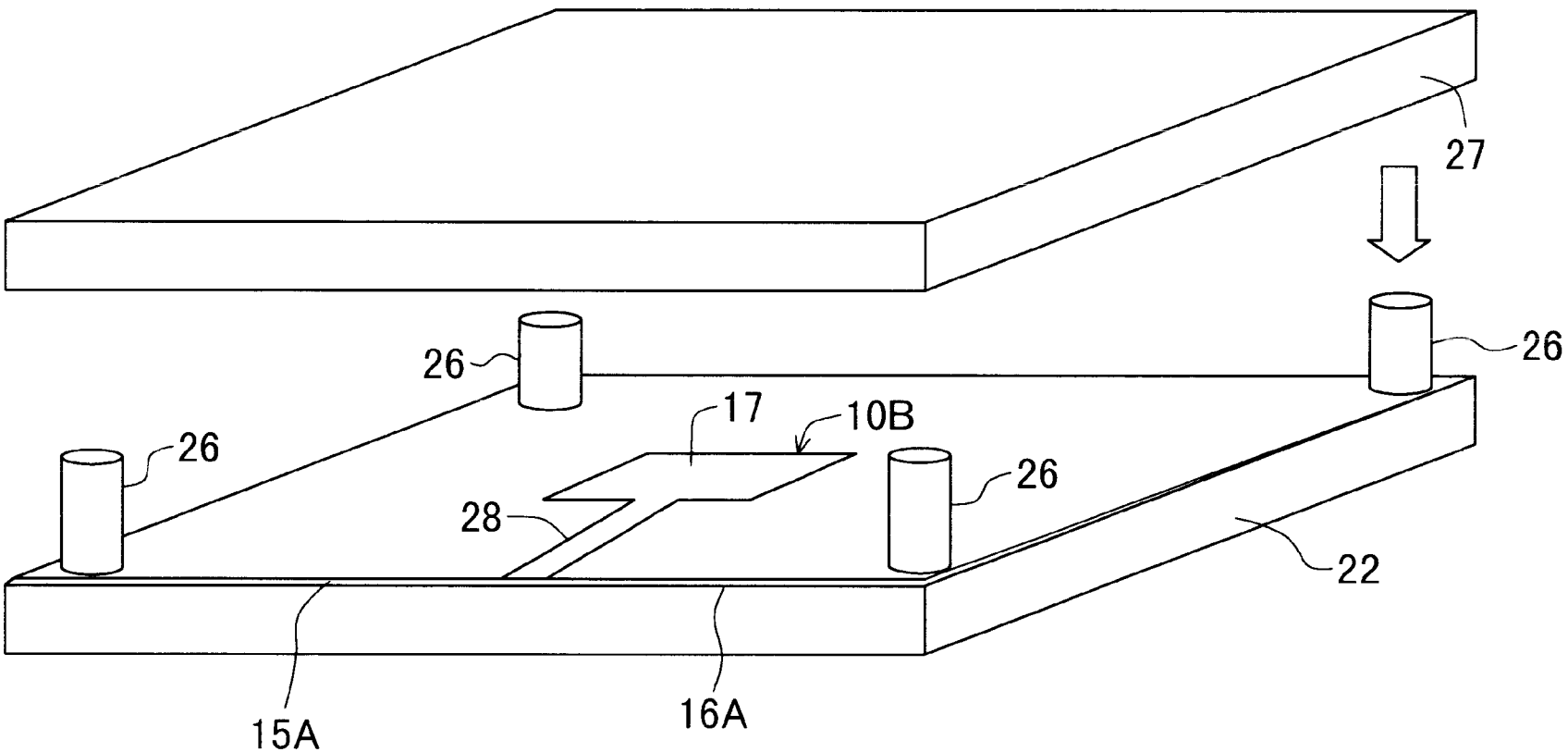
FIG. 5 is a partially exploded perspective view of an improved patch antenna of a second embodiment according to the present invention.

FIG. 5 is a partially exploded perspective view of an improved patch antenna of a second embodiment according to the present invention.

In a patch antenna 10B, a ground plane 16A has the same area as the supporting substrate 22, and high frequency power is provided to the patch plane 17 through a micro strip line 28 formed on a dielectric substrate 15A.

The other points are the same as those of the first embodiment.

A similar effect to the first embodiment can be obtained by the second embodiment as well.

Third Embodiment

Figure 6:
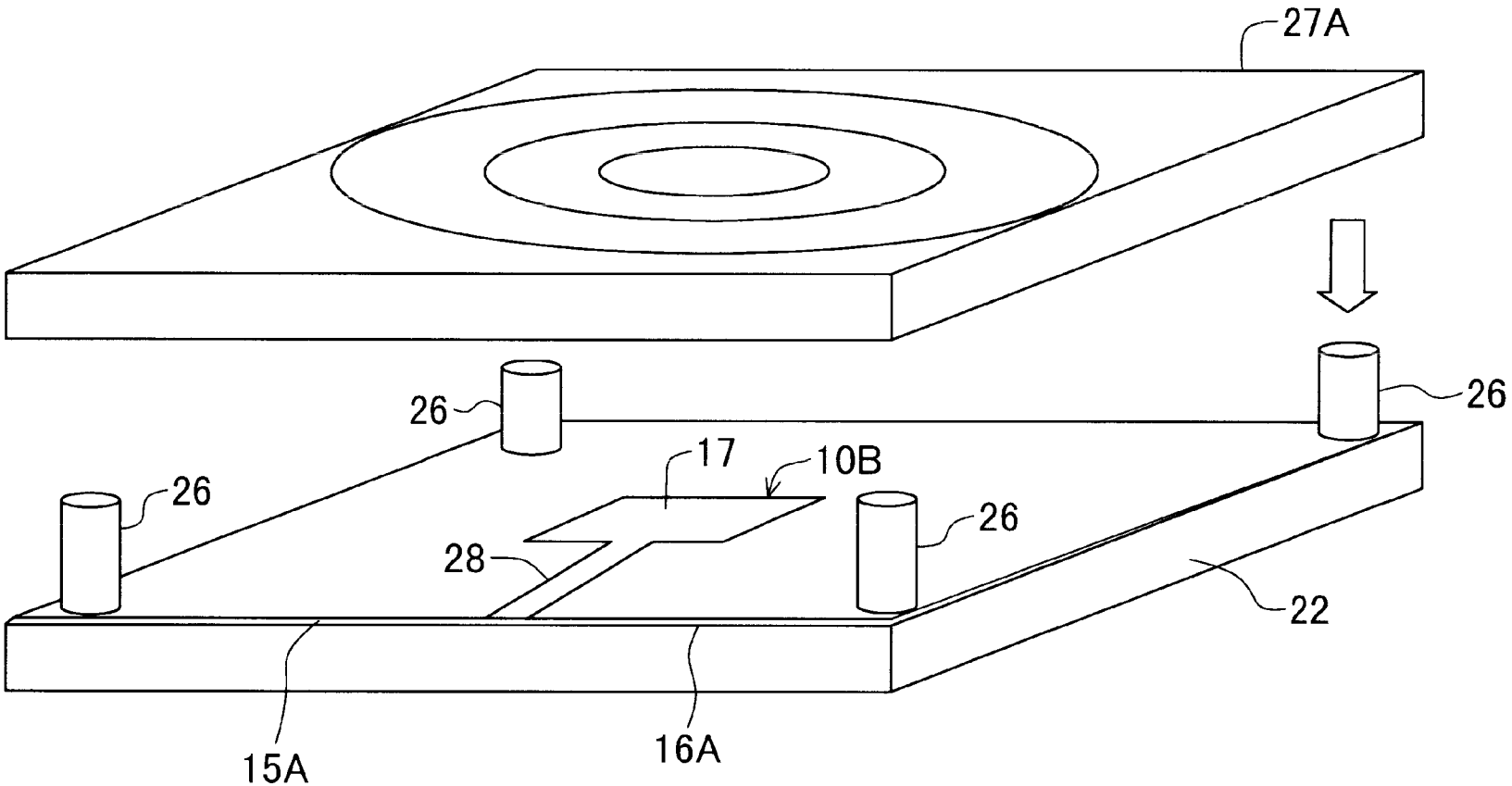
FIG. 6 is a partially exploded perspective view of an improved patch antenna of a third embodiment according to the present invention.

FIG. 6 is a partially exploded perspective view of an improved patch antenna of a third embodiment according to the present invention.

This antenna employs a dielectric member 27A instead of the dielectric member 27 of FIG. 5.

Figure 7:
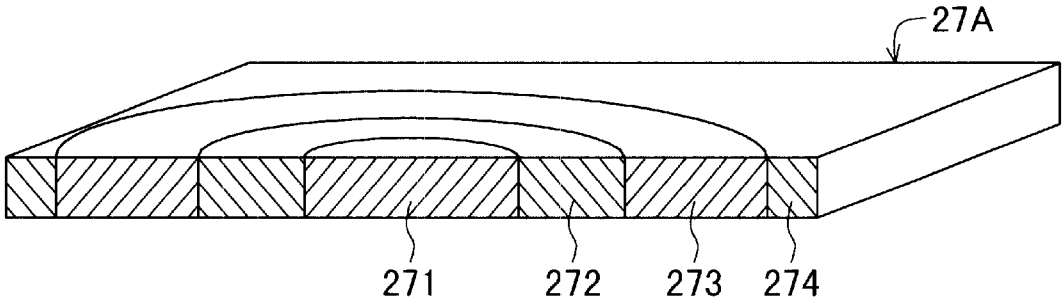
FIG. 7 is a perspective view showing a cross-section of a dielectric member 27A of FIG. 6.

FIG. 7 is a perspective view showing a cross-section of the dielectric member 27A of FIG. 6.

The dielectric member 27A is constructed of circular dielectric 271 in the central portion, annular dielectrics 272 and 273 around the circular dielectric 271, and the outermost dielectric 274. Dielectric constants of the dielectrics 271 to 274 are different from each other and any outer dielectric has a larger dielectric constant than that of the inner one. With such a configuration, the dielectric member 27A works as a dielectric lens as well, and therefore the directivity is improved compared with the second embodiment to increase the gain of the antenna.

Fourth Embodiment

Next, description will be given of a case where a conductive surface is disposed on the ground plane side of a patch antenna, as a fourth embodiment according to the present invention.

Figure 8A:
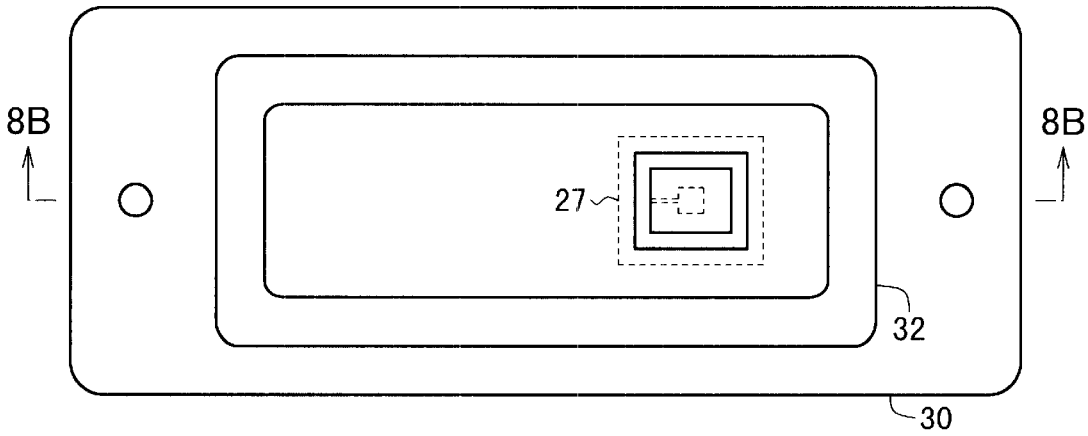
FIG. 8(A) is a plan view of a communication module employing the antenna of FIG. 5.
Figure 8B:
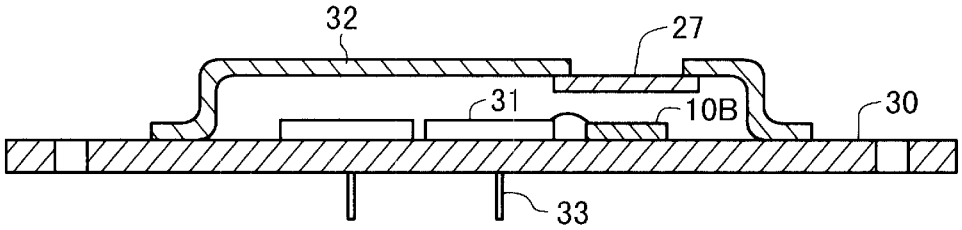
FIG. 8(B) is a partially cross-sectional view taken along line 8B—8B in FIG. 8(A)

FIG. 8(A) is a plan view of a communication module employing the antenna of FIG. 5, and FIG. 8(B) is a partially cross-sectional view taken along line 8B—8B in FIG. 8(A).

In this communication module, the patch antenna 10B of FIG. 5 is soldered on the conductive substrate 30 with its ground plane in contact with the substrate 30. On the substrate 30, a plurality of MMICs 31 are soldered and one of the plurality of MMICs 31 and the patch antenna 10B are connected by bonding wires. On the substrate 30, a cover 32 is fixedly mounted so as to cover the patch antenna 10B and the MMICs 31. An opening is formed in the cover 32 above the patch antenna 10B and the dielectric member 27 is fixedly attached to the opening. Pins 33 projected outward from the substrate 30 are for use in feeding power and signals to the MMICs 31.

In the fourth embodiment, the ground plane is in contact with the conductive surface of the substrate 30, and a reflected radio wave from the surface of the substrate 30 and a direct radio wave radiated from the patch antenna 10B to the dielectric member 27 have substantially different phases from each other at the incident surface of the dielectric member 27. Since it is not easy to make the phases coincident with each other, this condition of the different phases is usually established automatically unless positioning is intentionally performed so as to achieve coincidence between the phases. Especially, if both phases are made to be in opposite with each other in design, the above-described condition can be easily established even if the parts thereof are in poor dimensional precision.

Figure 9:
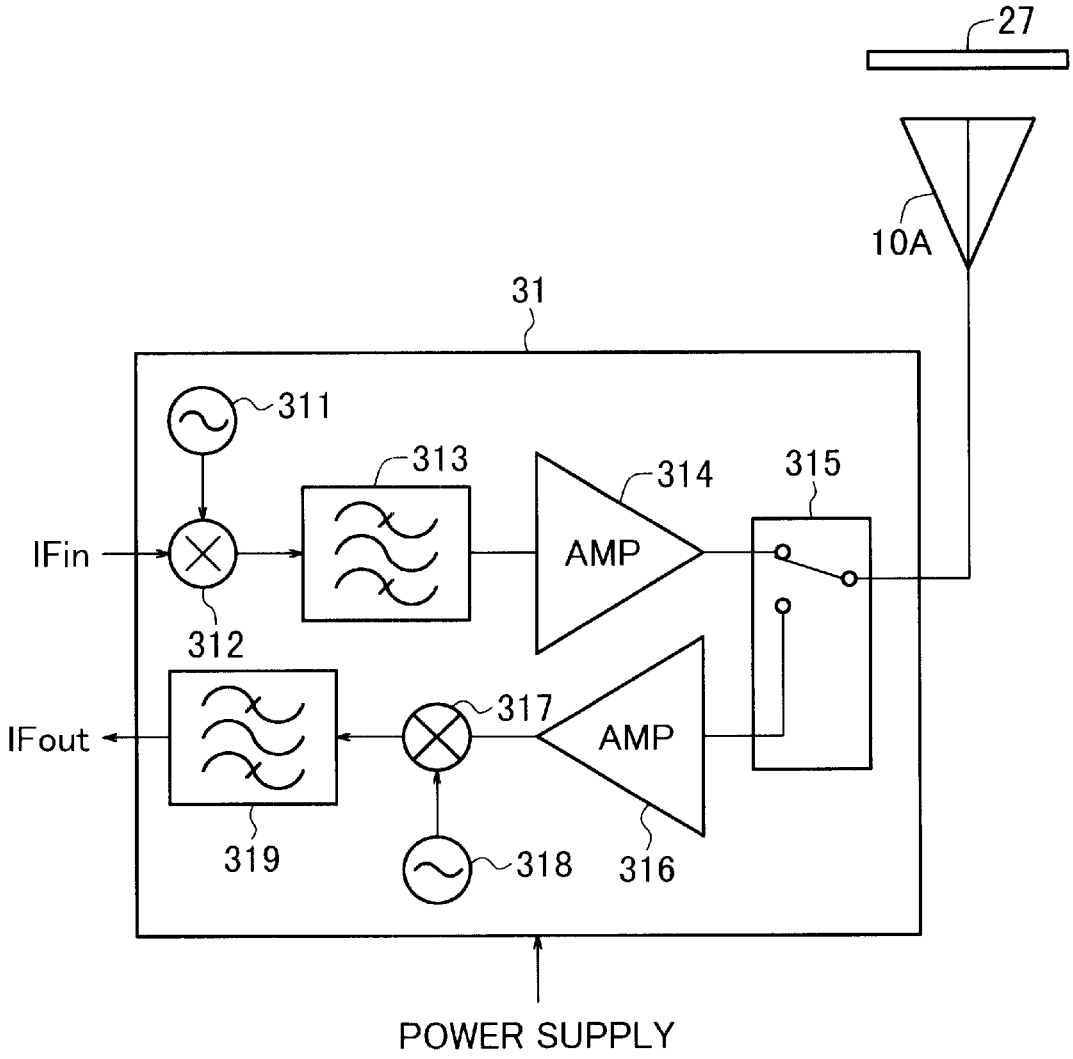
FIG. 9 is a schematic block diagram of an MMIC of FIG. 8.

FIG. 9 is a schematic block diagram of the MMIC 31.

In the MMIC 31, the output of a local oscillator 311 and a signal IFin of intermediate frequencies are provided to a mixer 312 to shift the frequencies of the signal IFin to the upper and lower sides, and the upper side component passes through a band pass filter 312 and then amplified by an amplifier 314 to provide to a patch antenna 10B through a switching circuit 315. In the case of reception, a received signal is provided from the antenna 10B through the switching circuit 315 to the amplifier 316, amplified in the amplifier 316 and provided to a mixer 317 to shift the frequencies of this provided signal to the upper and lower sides by a frequency of a signal from a local oscillator 318, and the lower side component passes through a band pass filter 319 to output a signal IFout of intermediate frequencies.

According to the fourth embodiment, since the dielectric member 27 is attached to the cover of the communication module, high gain of the antenna can be achieved with substantially the same size as the prior art patch antenna.

Although preferred embodiments of the present invention has been described, it is to be understood that the invention is not limited thereto and that various changes and modifications may be made without departing from the spirit and scope of the invention.

For example, a patch antenna employed in the present invention may have various kinds of patch planes in shape such as a shape having a notch or a slot and a circular shape, and further a power feeding point to a patch plane may be determined according to applications.

What is claimed is:

1. An antenna comprising:

a patch antenna including: a patch plane provided with high frequency power to radiate a radio wave; and a ground plane separated from said patch plane opposite to said patch plane; and a dielectric member disposed on the patch plane side of said patch antenna opposite to said patch plane with a distance of $0.1\lambda_0$ to $2\lambda_0$ from said patch plane, where $\lambda_0$ denotes a wavelength of a radio wave, in a free space, radiated from said antenna;

wherein a plane located opposite to said patch antenna on the opposite side to said dielectric member with respect to said patch antenna is a conductive plane, wherein said conductive plane is separated from said dielectric member by such a distance that a phase of said radio wave directly reached an incident surface of said dielectric member is substantially different from that indirectly reached said incident surface after having been reflected by said conductive plane.

2. The antenna of claim 1, wherein said dielectric member has a thickness of from $0.1\lambda$ to $2\lambda$, where $\lambda$ is a wavelength of said radio wave in said dielectric member.

3. The antenna of claim 1, wherein said dielectric member has a first dielectric in a middle portion thereof and a second dielectric disposed around said middle portion with a dielectric constant lower than that of said first dielectric.

4. The antenna of claim 1, further comprising a dielectric substrate interposed between said patch plane and said ground plane.

5. The antenna of claim 2, further comprising a dielectric substrate interposed between said patch plane and said ground plane.

6. The antenna of claim 3, further comprising a dielectric substrate interposed between said patch plane and said ground plane.

7. The antenna of claim 4, wherein said dielectric member is a substrate arranged in substantially parallel to said dielectric substrate.

8. The antenna of claim 1, wherein said dielectric member is separated from said patch plane by an air gap.

9. The antenna of claim 2, wherein said dielectric member is separated from said patch plane by an air gap.

10. The antenna of claim 3, wherein said dielectric member is separated from said patch plane by an air gap.

11. The antenna of claim 4, wherein said dielectric member is separated from said patch plane by an air gap.

12. The antenna of claim 2, further comprising: a supporting substrate for mounting said patch antenna, wherein said non-conductive plane is a surface of said supporting substrate.

13. The antenna of claim 12, wherein said ground plane is contacted with said surface of said supporting substrate.

14. The antenna of claim 2, further comprising: a supporting substrate for mounting said patch antenna, wherein said conductive plane is a surface of said supporting substrate.

15. The antenna of claim 14, wherein said ground plane is contacted with said surface of said supporting substrate.

16. A communication module comprising:

a conductive substrate;

an antenna mounted on said conductive substrate; and a communicating MMIC mounted on said conductive substrate and connected to said antenna;

wherein said antenna comprising:

a patch antenna including: a patch plane; and a ground plane separated from said patch plane opposite to said patch plane; wherein high frequency power is provided to said patch plane to radiate a radio wave; and a dielectric member disposed on the patch plane side of said patch antenna opposite to said patch plane with a distance of $0.1\lambda_0$ to $2\lambda_0$ from said patch plane, where $\lambda_0$ denotes a wavelength of a radio wave, in a free space, radiated from said antenna;

wherein said ground plane is contacted with a surface of said conductive substrate, wherein said dielectric member is separated from said surface by such a distance that a phase of said radio wave directly reached an incident surface of said dielectric member is substantially different from that indirectly reached said incident surface after having been reflected by said conductive plane.

17. The communication module of claim 16, wherein said dielectric member has a thickness of from $0.1\lambda$ to $2\lambda$, where $\lambda$ is a wavelength of said radio wave in said dielectric member.

18. The communication module of claim 17, further comprising:

a cover, mounted on said conductive substrate so as to cover above said antenna and said MMIC, having an opening at a portion corresponding to said antenna;

wherein said dielectric member of said antenna is attached to said opening at a peripheral portion of said dielectric member.

* * * * *